US006214411B1

(12) United States Patent
Graefenhain-Thoma et al.

(10) Patent No.: US 6,214,411 B1
(45) Date of Patent: Apr. 10, 2001

(54) METHOD FOR ECONOMICALLY REPAIRING A DEFECTIVE SPOT ON A NEW MOTOR VEHICLE EXTERIOR PAINT COAT

(75) Inventors: Elisabeth Graefenhain-Thoma, Zimmern; Guenter Weickum, Heimsheim; Werner Sedelmaier, Simmozheim; Arno Mueller, Boeblingen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 08/833,477

(22) Filed: Apr. 7, 1997

(30) Foreign Application Priority Data

Apr. 6, 1996 (DE) ..... 196 13 915

(51) Int. Cl.[7] ..... B05C 13/00
(52) U.S. Cl. ..... 427/142; 427/140
(58) Field of Search ..... 427/142, 271, 427/287, 299, 327, 409, 388.1, 420

(56) References Cited

U.S. PATENT DOCUMENTS

| | | | | |
|---|---|---|---|---|
| 4,157,126 | | 6/1979 | Collonia . | |
| 4,265,936 | * | 5/1981 | Prohaska, Jr. | 427/142 |
| 4,273,808 | * | 6/1981 | Neirynck et al. | 427/142 |
| 5,028,456 | * | 7/1991 | Naton | 427/142 |
| 5,169,723 | * | 12/1992 | Forster | 427/142 |

FOREIGN PATENT DOCUMENTS

| | | |
|---|---|---|
| 38 33 225 C2 | 4/1989 | (DE) . |
| 40 09 000 A1 | 9/1991 | (DE) . |
| 43 29 897 A1 | 3/1995 | (DE) . |
| 0 668 331 A1 | 8/1995 | (EP) . |
| 2 210 291 | 6/1989 | (GB) . |
| WO 93/10912 | 6/1993 | (WO) . |

* cited by examiner

*Primary Examiner*—Shrive Beck
*Assistant Examiner*—Jennifer Kolb
(74) *Attorney, Agent, or Firm*—Evenson, McKeown, Edwards & Lenahan, P.L.L.C.

(57) ABSTRACT

A method provides for small-surface and cost-saving repair of a damaged spot or a defective paint spot on a new paint coat of a motor vehicle. The damaged spot is cleaned and, without being ground out, is laid out carefully and with a slight excess with a filler mass whose shade approaches that of the respective paint coat. Thereby, the undamaged paint surface directly next to the damaged spot remains free of filler mass. After the drying of the filler mass, the excess of the laid-out damage spot is levelled off. After the cleaning of the levelled-off damage spot, a paint is applied to the spot in a small-surface and thin manner which in its color corresponds to the finish paint coat. The spraying nozzle is radially guided centrifugally away from the damage spot. After a ventilating or drying of the applied tinted paint, a solvent-containing transparent coat is applied to the repaired spot also on a small surface. In the edge area of the transparent coating application, a spray solutizer is then sprayed on and the paint is then dried locally.

20 Claims, 2 Drawing Sheets

METHOD FOR ECONOMICALLY REPAIRING A DEFECTIVE SPOT ON A NEW MOTOR VEHICLE EXTERIOR PAINT COAT

BACKGROUND AND SUMMARY OF THE INVENTION

This application claims the priority of 196 13 915.5, the disclosure of which is expressly incorporated by reference herein.

The present invention relates to a method for economically repairing a mechanical defective spot on a new exterior paint coat of a motor vehicle.

German Patent 38 33 225 C2 describes a method for the locally point-limited repairing of paint defects in new paint coats on vehicle bodies. Specifically, the defective spot (for example, a particle inclusion, a small bubble or a thin spot because of an oil droplet on the background), is burned out by a focussed laser beam. The resulting small cavity is filled in on a small surface by a hardenable repair mass which matches the color of the surrounding paint, and a clear coating is applied also to a small surface. The repair mass is applied in different fashions.

Specifically, the following known methods are described in that document:

- Locally targeted melting-open of a small quantity of repair mass by a focussed laser beam from a laid-on foil made of repair mass and simultaneous application of the melted-out quantity into the exposed cavity.
- Melting-open of the powdered repair mass pressed to form a small pellet, the pellet being placed on the cavity, and depositing such a small drop in the cavity.
- Depositing a small droplet of an originally liquid repair mass in the cavity, the droplet being guided into the cavity on the tip of a needle.

The hardening of the repair mass usually takes place thermally. However, the German patent document also mentions a hardening by UV-radiation. The repair mass and the clear coating can be hardened successively or, in the instance of a wet-in-wet application, may be hardened simultaneously. In any event, the hardening takes place by a locally targeted, small-surface addition of heat, for example, by a focussed, high-energy beam, by applying a hot gas by means of a nozzle, and by other methods. A possible projection of the applied repair mass above the cavity or a projection of the subsequently applied clear coating will be mechanically removed on a small surface.

By way of the repair, the locally disturbed paint layer is closed and, as a result, the protective function is restored also at the defective point. The repaired spot may also look better than the untreated defective paint spot and is less noticeable than the original paint defect. The known punctiform paint repair method has a disadvantage, however, in that it cannot completely visually remove the defective paint spot. That is, the repair spot can still be recognized at least when the demands on the paint coat are high and the paint coat is therefore critically inspected.

German Patent DE 40 09 000 A1 and German Patent DE 43 29 897 A1 describe a process for the multi-layer repair of a damage in a vehicle paint coat. Here, the defective spot in the multi-layer paint coat is first ground out down to the metal sheet, resulting in a ground spot of a diameter of approximately 5 cm. The ground-through spot is cleaned and is filled in with a known repair priming, thereby forming a film. The primed spot will then have a diameter of at least approximately 10 cm. A filler is applied to the priming in a film-forming manner. The repaired spot will then have a diameter of at least 15 cm. A paint layer in a covering layer thickness, which matches the color determining paint coat will then be applied to the filler layer, in which case the paint is applied so that, at the edge it will run out toward the old paint coat. A clear coating will then be applied over it which results in a further enlargement of the repair spot.

Before the application of the next layer, the individual applications are each ventilated to form a stable film or are partially dried. At least at the conclusion, the paint layers are jointly hardened at temperatures of above 100° C. It is also suggested that a baking-in of individual layers can take place in-between.

This repair method has a disadvantage in that, with the recommended limitation of the application of the color-determining paint layer and of the clear coating layer to the repair spot, recognizable differences in color and brilliance occur in the transition area to the untreated old paint coat. These differences are particularly clearly noticeable especially with light metallic paints. For this reason, the customer cannot be expected to accept the repaired paint coat when used on exterior surfaces of the vehicle body according to the described method.

When repairing defects and damages on new paint coats in vehicle series production, it is therefore required and customary to coat the entire involved vehicle body part to the next body joint uniformly with the color determining paint layer and with the transparent coat in order to reliably exclude unattractive color edges around the repaired spot. Although damaged spots can be repaired in this manner which can then no longer be recognized, considerable expenditures are required for this purpose which are not easily recognizable. In particular:

- In addition to the vehicle body part to be repaired and painted, the entire vehicle must be covered in a firmly adhering manner and, prior to that, temperature-sensitive inside and outside accessories must be demounted. Then, these parts must naturally be mounted again. This labor-intensive work is connected with high wage costs.
- Large amounts of covering foil are consumed which can be used only once. Apart from the consumption of foil, a large amount of garbage is created and results in unnecessary costs.
- Because of the multitude of vehicles to be repainted, a very large amount of space is required for the described preparation of the vehicles for the repainting. This requires high investment costs for corresponding large hangars and pieces of land.
- The demounting and mounting work itself causes possibilities of errors with respect to the function of the newly mounted parts. Furthermore, occasionally this work may cause new or additional damage to the paint.
- Just the size of the spot to be repainted may result in the possibility and probability of new defective paint spots.
- This large-surface repainting creates a relatively high demand for material and will also require a relatively large amount of time which also leads to correspondingly high costs for material and wages.
- The energy requirement for the baking and cooling of the large-surface new paint coats is correspondingly high so that stationary heat radiation tunnels with adjoining cooling tunnels are required. The corresponding investment costs and the continuous energy costs are therefore correspondingly high.

Despite these cost disadvantages of large-surface repainting, small-surface repair painting is not known so far to have been accepted in practice for high-quality exterior paint coats because, with known repair painting methods, the repaired spots were always more or less easily recognizable.

It is, therefore, an object of the present invention to optimize a repair method such that damaged spots and small defective paint spots on new exterior paint coats of motor vehicles, on one hand, can be repaired at significantly lower costs and, on the other hand, without visually recognizable traces.

According to the present invention, this object has been achieved by providing a method in which (a) cleaning the damage spot and, without being ground out, laying out the spot with an excess of filler mass which approaches a finish paint coat in a color-determining shade such that an undamaged paint surface directly next to the spot remains free of filler mass, (b) levelling off a projection of the laid-out damage spot after the drying of the filler mass, (c) cleaning the levelled-off damage spot and applying a paint which, with respect to the color, corresponds to the finish paint coat to the damage spot on a small surface, which projects thinly over the damage spot on all sides thereof by approximately 4 to 6 cm, so as to have a thickness of approximately 10 to 20 $\mu$m, (first repair finish paint layer 10), by guiding a spraying element radially and, centrifugally away from the damage spot, (d) ventilating or drying the applied paint in step (c) and then applying a transparent coat to the spot on a small surface, that is, projecting over the repainted surface on all sides by approximately 2 to 4 cm, (e) adjusting a transition area from the transparent coat application into the original finish paint coat by slight dissolving of the uppermost layer of original finish paint via a sprayed-on solutizer, and (f) locally drying the coats applied to the spot.

The decisive advantage of the present invention is a considerable cost saving effect which is based on the fact that the repair spot according to the invention can be kept small; that is, for example, below a diameter of from 20 to 25 cm. The breakthrough to a repaired and repainted spot which is small as well as perfect with respect to the painting technique was achieved on the basis of the method according to the invention as generally described above.

The repaired spot obtained according to the method of the present invention satisfies strict standards and withstands critical examination. This functional advantage, which can be achieved only as the result of the present invention, is, on one hand, also based on the small size of the repaired spot and, on the other hand, on the thin, possibly repeated application of the paint. This avoids cloudiness and disturbing edge or transition effects in an easily controllable manner. The repair of the damaged spot can no longer be recognized even by the trained eye, although the repaired spot changes over freely into the undisturbed surface of the vehicle body part or into the original paint coat.

The cost advantages which can be achieved by the repair method according to the invention are based on the following:

Firmly adhering, total coverings of the vehicle and a demounting and subsequent mounting of temperature sensitive inside and outside accessories, as well as a covering or demounting/mounting of the also temperature-sensitive vehicle wheels, are not necessary. This work is very labor intensive and therefore connected with high wage costs which are now eliminated.

As the result of the previously required, firmly adhering overall covering, large amounts of cover foil were used up which could be used only once. Apart from the high foil consumption, a large amount of garbage was generated in this manner which had to be disposed of at cost. Now, the vehicle body parts must only be covered in a firmly adhering manner at the repair spot over a small surface. The consumption of cover foil and adhesive tape as well as the corresponding garbage is reduced to a small fraction of the original quantities. In addition, cover paper can now be used which can be procured at a much lower price and can be disposed of at lower cost. If, during the repair, the vehicle must be covered over large surfaces, reusable cover parts can be used.

The space requirement for the previously necessary covering and demounting/mounting was previously very high because of the large number of vehicles to be repainted which also led to high investment costs for corresponding hangar spaces. These costs will no longer be incurred.

When a change takes place from an existing conventional repainting to the repainting according to the present invention, hangar space in the order of from approximately 15 to 20% of the surface requirement for the overall painting of vehicles becomes free and can be used for other purposes.

Because of the elimination of the demounting and mounting work, a large amount of error possibilities with respect to the function of the newly mounted parts is eliminated. Furthermore, the previously required demounting and mounting of parts repeatedly resulted in new or additional damage to the paint. Because this work has now been eliminated, the rejection rate of the repainting is therefore reduced.

Solely because of the smaller size of the spot to be repainted, the miniaturization of the spots to be repaired has the advantage that the possibility of new defective paint spots is significantly reduced in comparison to a large-surface repainting. Thereby, almost without exception, the paint coats repaired according to the invention are acceptable which is only partially true in the case of repaired large-surface paint coats.

The requirement of material and time for the small-surface repainting is clearly reduced in comparison to the large-surface repair, and this leads to correspondingly lower costs for material and wages.

The energy requirement for the baking and cooling of the small-surface repainting is correspondingly lower so that smaller heat radiators are required, for example, individual movable infrared radiators, in comparison to complete stationary heat radiation tunnels with adjoining cooling tunnels. As a result, apart from the above-mentioned lower space requirement, the respective investment costs for small heat radiators and, of course, also the continuous energy costs are clearly lower.

With the method according to the invention, not only small mechanical damage (as a rule, scratches or the like) can be effectively repaired at low cost, but the method is also suitable for repairing small paint defects which at first have no cavity but, on the contrary, enclose small particles or a small bubble in the solidified paint. If such a paint defect is carefully provided with a fine cavity and the defective spot is removed from the paint surface, the cavity can then be repaired like a mechanically damaged spot in the above-mentioned manner. The fine cavity can be produced mechanically or thermally.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
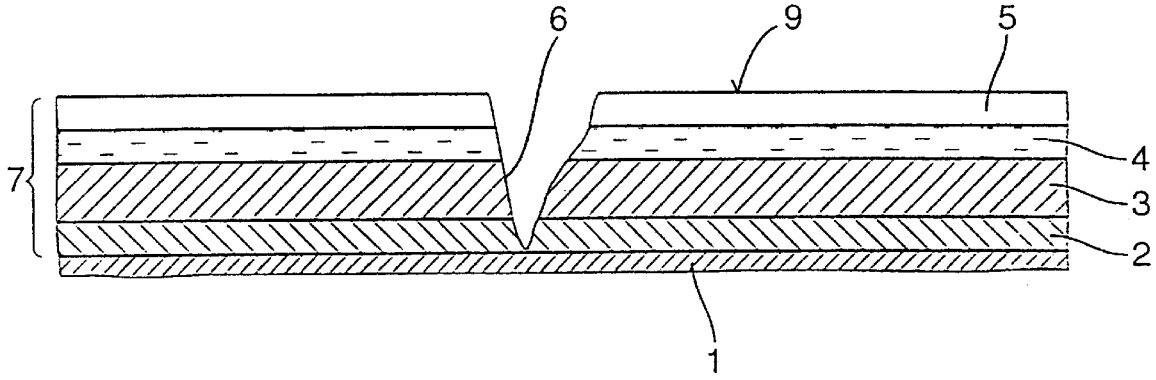
FIGS. 1 to 7 are cross-sectional views of a defective spot of a paint coat to be repaired, by a representation which is considerably vertically (i.e. heightwise) exaggerated in the direction of the paint thickness, in different phases of the repairing process according to the method of the present invention.

The new multi-layer paint coat, which is designated overall by numeral 7 and cross-sectionally illustrated in the figures, is applied to a body metal sheet 1. An electrophoretically applied dip priming 2 is applied to a phosphating (not shown). A filler paint layer 3 is applied to the dip priming 2. Then the color-determining cover paint coat 4, such as a silver-metallic paint, is applied, and finally a transparent coating layer 5 is applied. The paint coat contains mechanical damage 6 in the form of a scratch which has a V-shaped cross-section and must be repaired.

For the economical repair of this mechanically damaged spot 6 in the new paint coat 7 of a motor vehicle, the following steps take place:

(1) The damaged spot itself is cleaned by a blowing out by compressed air and its surroundings are cleaned by a silicone remover (FIG. 1).

Figure 2:
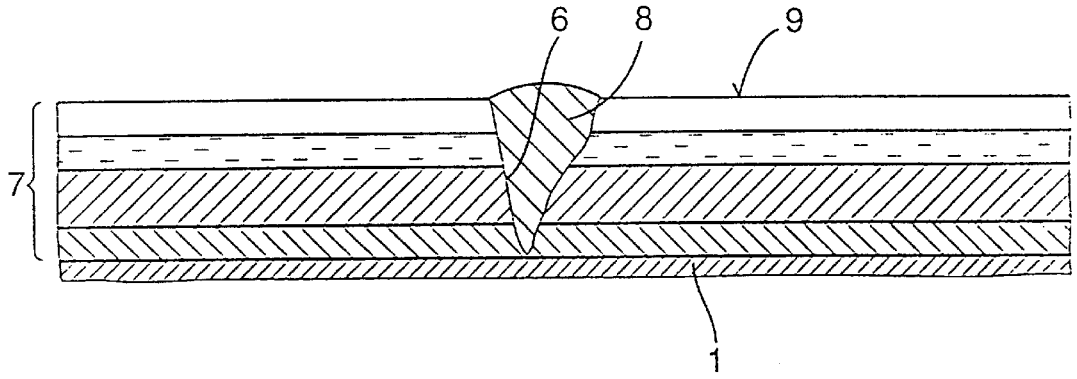

(2) Then, without being ground out, the damaged spot corresponding to FIG. 2 is directly laid out sparingly but with a slight excess of a filter mass 8 whose color approaches that of the respective paint coat so that the undamaged paint surface 9 directly next to the damaged spot 6 remains free of filler mass 8. The filler mass is expediently applied by a fine needle. As the result of the color matching of the filler mass to the color of the color-determining finish paint, this paint can be applied quite sparingly for the finishing by a later layer of finish paint. The sparing laying-out of the damaged spot with filler mass has a similar effect. Consequently, the finish paint can later be applied on a small surface.

For the laying-out of the damaged spot, a two-constituent filler material is used which, under the effect of heat, hardens faster than, for example, a comparable filter material on a solvent base. The laid-out damaged spot is dried under a small heat radiator which is essentially limited to the damaged spot. Specifically, the drying takes place for approximately 5 minutes at approximately 70 to 80° C. In order not to overheat the surface but nevertheless be able to maintain the desired drying temperature, a conventional temperature-controllable heat radiator is preferably used which can sense the object temperature without contact and can therefore automatically control this temperature.

Figure 3:
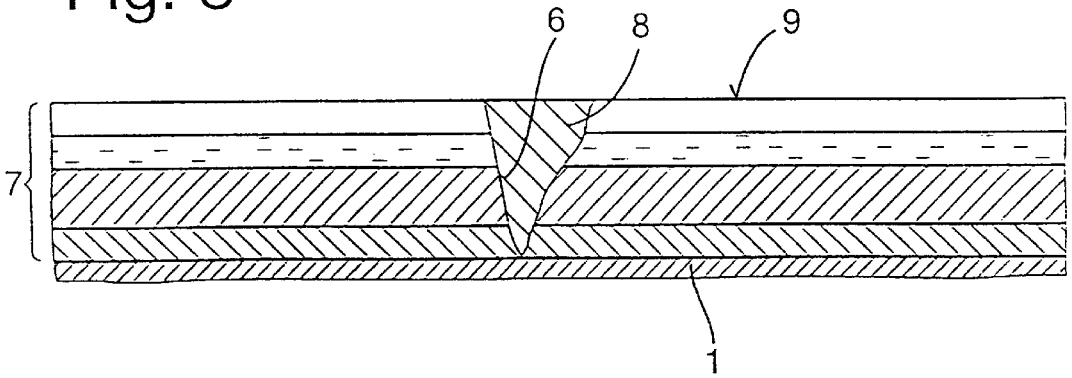

(3) After the drying of the filler mass, the projection of the filler mass is levelled off (FIG. 3). For this purpose, the projecting filler mass first is carefully and over a small surface, ground down by a fine abrasive paper of a 1200 grain and a manually guided grinding disk of a diameter of approximately 2 to 5 cm. The ground-down spot is then polished by lambskin and polishing solution. Then the polished surface is cleaned with a silicone remover in order to remove residues of polish and paint material.

Figure 4:
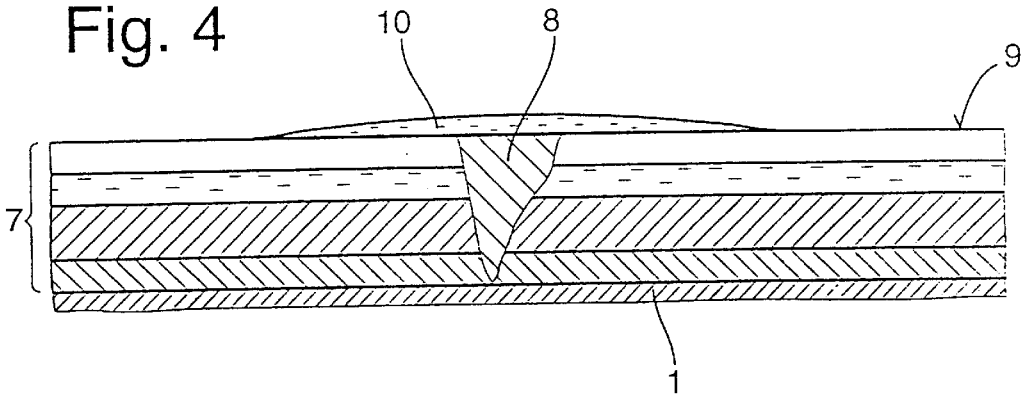

(4) After the cleaning of the levelled-off damage spot, a finish paint is then applied thereto in a small-surface and thin manner whose color corresponds to the finish paint coat (first finish paint coat 10 in FIG. 4). The application conditions will be explained in detail below. The viscosity of the paint used does not have to be changed with respect to the finish paint used for the series paint coat. Also, as far as the other formulation parameters of the finish paints are concerned, the series finish paints can largely also be used for the repair painting. Only in the case of light metallic paints, a special repair paint should be used which differs from the metallic paint of the series finish paints in that the distribution spectrum of the metal pigments is cut back in the range of large metal pigments. That is, the larger metal pigments are filtered or sifted off.

(5) During the repair painting, the finish paint is applied to a surface which is as small as possible, projecting over the damage spots on all sides by approximately 4 to 6 cm, as well as in a thin manner, i.e., in a thickness of approximately 10 to 20 $\mu$m. During the painting, the spraying element is guided radially and, centrifugally away from the damage spot. After some practice, an experienced painter will easily be able to apply also metallic paints without shadows and transitions toward the original paint coat to the locally limited repair spot. For the finish paint application, spray guns made by the firm Sata with the size designation 90 or of the name Mini Jet with nozzles of a size of from 1.1 to 1.3 mm (normally, nozzles of approximately 1.8 mm and more are contemplated) are used.

As far as both the gun size and the nozzle size are concerned, smaller apparatuses or apparatus parts are used in the repair painting in order to be able to apply the paint to a surface which is as small and as thin as possible. For the same purpose, an air pressure on the nozzle of only approximately 0.7 bar is used which is reduced in comparison to normal painting conditions (approximately 2 to 3 bar). Finally, the painter guides the spray gun or the nozzle closer than normal to the paint surface, i.e. is at a distance of approximately 10 to 20 cm.

(6) Before a further treatment of the repair spot, the applied finish paint should at least be ventilated. For this purpose, dry air is blown on the spot for approximately 3 minutes at approximately room temperature. A drying of the applied paint in this stage is also permissible but not required.

Figure 5:
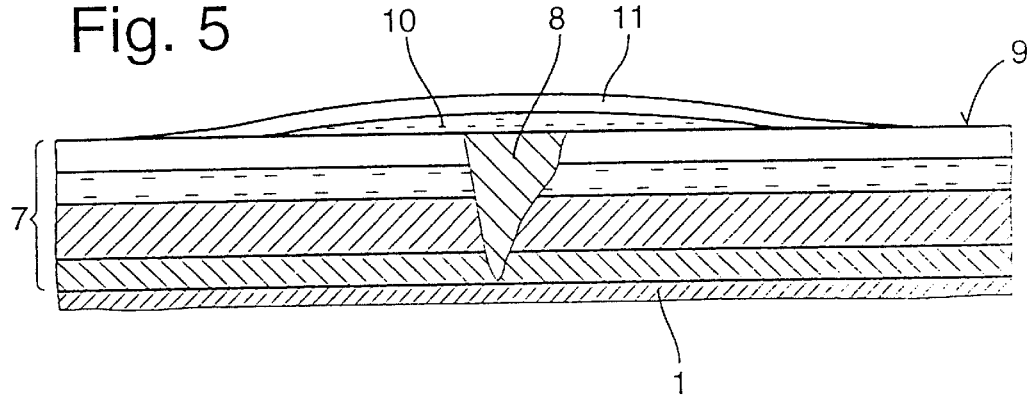

(7) After the ventilating (or drying) of the applied finish paint, a transparent coat is applied to the repair spot over a small surface (first transparent coat layer 11 in FIG. 5). The transparent coat projects on all sides by approximately 2 to 4 cm over the surface previously repainted with the finish paint color. For applying the clear coat, a diluted transparent coat is used, preferably as a two-constituent coat. The transparent coat can be adjusted to be thinner than its normal viscosity, specifically to an efflux time of 20 to 30 seconds, preferably 20 to 22 seconds normally measured here according to DIN 53 211.

For the measuring conditions according to DIN 53 211 the following applies: using of a measuring beaker with a 4 mm discharge nozzle, and maintaining a paint temperature of 20° C. during the measurement. During repainting work on Mercedes-Benz vehicles, a fine-spraying element of the firm Sata was used in the application of the transparent coat which had the size designation 90 and a nozzle of an opening diameter of 1.1 to 1.3 mm. A pressure of approximately 1.5 to 2 bar was adjusted at the spray gun which was only slightly reduced in comparison to the normal application technique. A reduced distance of the spray nozzle from the vehicle body surface of approximately 10 to 20 cm was maintained.

For a uniformly thin and small-surface application, it is also advantageous during the application of the transparent coat that the spray gun is guided radially, whereby the nozzle is moved from the center toward the outside. Subsequently, the transition area from the transparent-coat application into the original new paint coat was adjusted by slightly dissolving the original paint by a sprayed-on spray solutizer of the Firm BASF Farben+Lacke AG, Münster Germany, with the designation SF 46-0300. The surface 9 of the paint coat 7 will react to the spray solutizer despite being hardened because the reactivity of the new paint disappears only after several days. As the result of the slight dissolving of the newly applied transparent coat and of the transparent coat of the original paint coat, both change into one another at the edges of the repair spot without dulling and with a constant brilliance. After a short effect period and progression time, the coat applied to the repair spot can be dried locally.

(8) For drying the coat applied to the damage spot, as also during the drying of the laid-out filler mass 8, advantageously a temperature-controllable heat radiator is used which is positioned in a constant relative location with respect to the vehicle body and at a certain distance to the application site. The heat radiator is locally movably held and is adjustable by a stand. The paint is dried for 15 to 30 minutes, preferably approximately 20 minutes at an object temperature of from 70 to 95° C., preferably approximately 80° C. After the cooling of the repaired spot approximately to room temperature, it can be manually ground down, for example by a 2,000 grain abrasive paper and can then be polished with a polishing solution and a rotating lambskin disk.

When repairing vehicle body parts which were painted in dark plain paints or dark metallic paints with a low proportion of metal pigments, a one-time covering of the repair spot is sufficient. Vehicle body parts painted with light plain paints or with light effect paints with a high proportion of metal pigments, particularly with a silver-metallic paint, may require for a complete covering of the repaired spot, a second painting with the finish paint color.

Figure 6:
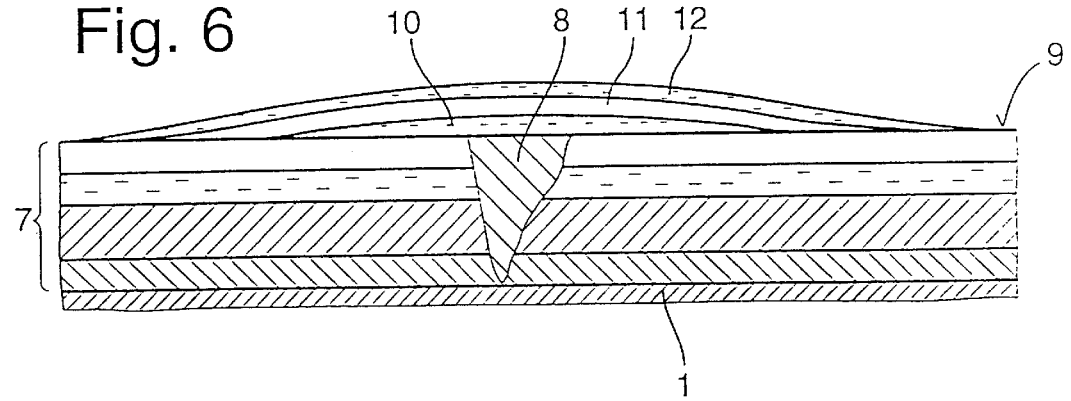
Figure 7:
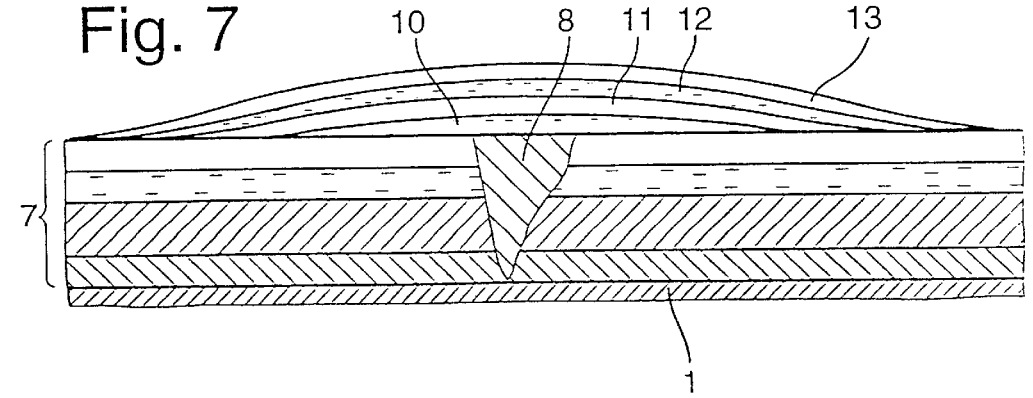

Accordingly, in the situation of vehicle body parts of light plain colors or light effect paints, the sequence of steps (4) to (8) described above was applied repeatedly so that, corresponding to FIGS. 6 and 7, a second finish paint layer 12 and a second transparent coat layer 13 is applied to the repaired spot. This results in a good covering effect. The two second paint layers do not have to be applied in diameters which are larger than those of the corresponding first paint layers situated underneath.

The repair method described here can also be used for repairing fine paint defects which occur during the painting itself, whether during a repainting or during a new painting of the vehicle body. Such painting defects usually result, before or during the painting, from a small grain of dust, a piece of fluff, or the like which falls on the object surface and is covered by the applied paint. This then results in a small elevation in the paint.

For repairing such a defective spot, a cavity is first locally applied, which is limited to the defective spot, without any impairment of the paint surface situated directly next to the defective spot, with respect to its depth. The cavity still remains within the multi-layer paint coat and does not penetrate to the metal sheet. Then this cavity is repaired like a mechanically produced damage spot in the above-described manner. The fine cavity can be produced mechanically or thermally. One approach for finely mechanically removing the defective paint spot consists of milling off the elevation by way of a manually guided, fine, high-speed hollow mill of the type of a dental drill and milling out a V-shaped cavity. Instead, it is also within the scope of the present invention to prick out the cavity by a percussion needle preferably driven in the ultrasonic range. When a fine cavity is generated thermally, for example, a high-energy beam is focussed to the defective spot, and as a result the cavity is "burned out". Preferably, a manually guided laser head of a pulse laser, particularly of an eximer laser, can be placed on the workpiece surface at the defective spot.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for economically repairing a mechanical damage spot on a new paint coat of a motor vehicle, comprising the steps of (a) cleaning the damage spot and, without being ground out, laying out the spot with an excess of filler mass which is color-matched to a finish paint coat such that an undamaged paint surface directly next to the spot remains free of filler mass, (b) levelling off a projection of the laid-out damage spot after the drying of the filler mass, (c) cleaning the levelled-off damage spot and applying a paint which, with respect to the color, corresponds to the finish pain coat to the damage spot on a small surface, which projects thinly over the damage spot on all sides thereof by approximately 4 to 6 cm, so as to have a thickness of approximately 10 to 20 $\mu$m, by guiding a spraying element radially and, centrifugally away from the damage spot, (d) ventilating or drying the paint applied in step (c) and then applying a transparent coat to the spot on a small surface, that is, projecting over the repainted surface on all sides by approximately 2 to 4 cm, (e) adjusting a transition area from the transparent coat application into the original finish paint coat by desired dissolution of the uppermost layer of original finish paint via a sprayed-on solutizer, and (f) locally drying by heating the coats applied to the spot.

2. Method according to claim 1, wherein, also during the application of the transparent coat constituted as a two-constituent coat, the spraying element is radially guided centrifugally away from the damage spot.

3. Method according to claim 1, wherein, at least when repairing vehicle body parts painted with light plain paints or with effect paints having a high metal pigment proportion, including a silver metallic paint, the sequence of steps (c) to (f) is applied repeatedly.

4. Method according to claim 1, wherein, for repairing vehicle body parts painted with a light effect paint with a high proportion of metal pigments of varying size, a repair paint has a distribution spectrum in which a range of larger metal pigments is reduced.

5. Method according to claim 1, wherein, for repairing fine paint defects, the spot is removed by first producing a cavity limited to the spot without any impairment of the paint surface situated directly next to the spot, with respect to its depth, the cavity still remaining within the multi-layer paint coat and not penetrating to the metal sheet, and the cavity is then repaired like a mechanically caused damage spot in the mentioned manner.

6. Method according to claim 1, wherein, for the step of cleaning of the spot, compressed air is first blown thereon and subsequently the spot and its surroundings are wiped out and off with a cleaning solution which liquifies without residue.

7. Method according to claim 6, wherein the cleaning solution is a silicone composition.

8. Method according to claim 1, wherein the step of laying out the spot in step (a) was a two-constituent filler material.

9. Method according to claim 1, wherein the filler mass for laying out the spot is dried for approximately 3 to 10 minutes at a temperature of approximately 70 to 80° C.

10. Method according to claim 1, wherein, the step of levelling-off of the laid-out spot comprises grinding off the spot with a 1,200 grain abrasive paper and a manually guided grinding disk of a diameter of approximately 2 to 5 cm, and subsequently polishing the spot with lambskin and a polishing solution.

11. Method according to claim 1, wherein the levelled-off damage spot and a surrounding area thereof are cleaned with a cleaning fluid which liquifies without residue.

12. Method according to claim 11, wherein the cleaning fluid is a silicone composition.

13. Method according to claim 1, wherein, the step of applying the paint comprises using a fine spraying nozzle and a pressure of approximately 0.7 bar, and maintaining a distance of the spraying nozzle from the vehicle body surface of approximately 10 to 20 cm.

14. Method according to claim 1, wherein the step of ventilating (in step d) the paint applied to the spot before the application of the transparent coat comprises blowing dry air at the tinted paint for approximately 3 minutes.

15. Method according to claim 1, wherein the step of applying the transparent coat in step (d) comprises using a diluted transparent coat, a spraying nozzle and a pressure of approximately 1.5 to 2 bar, and maintaining a distance of the spraying nozzle from the vehicle body surface of approximately 10 to 20 cm.

16. Method according to claim 15, wherein the viscosity of the transparent coat is adjusted to an efflux time of from 20 to 30 seconds according to DIN 53 211, the efflux time being measured using a measuring beaker with a 4 mm discharge nozzle at a paint temperature of 23° C.

17. Method according to claim 1, wherein the step of drying the paint applied to the damage spot uses a heat radiator held in a constant relative position with respect to a vehicle body being painted and at a certain distance from the spot.

18. Method according to claim 17, wherein the step of drying includes drying the applied paint for about 15 to 30 minutes at a temperature of from 70 to 95° C.

19. Method according to claim 1, further comprising the step of polishing the repaired spot after cooling has occurred.

20. Method according to claim 19, wherein the step of polishing the repaired spot comprises manually slightly wiping the spot with a 2,000 grain abrasive paper and then polished with polishing solution and lambskin.

* * * * *